United States Patent [19]

Tennant

[11] Patent Number: 4,662,132

[45] Date of Patent: May 5, 1987

[54] COLLAPSIBLE SUPPORT

[76] Inventor: James M. Tennant, 1476 N. Morningside Dr., NW., Altanta, Ga. 30306

[21] Appl. No.: 714,891

[22] Filed: Mar. 22, 1985

[51] Int. Cl.[4] ..... E04H 12/20

[52] U.S. Cl. ..... 52/148; 52/726; 248/159; 5/127

[58] Field of Search ..... 52/148, 149, 726, 632; 248/354.1, 354.4, 354.5, 408, 409, 159; 5/127–130

[56] References Cited

U.S. PATENT DOCUMENTS

| | | | |
|---|---|---|---|
| 201,074 | 3/1878 | Wheeler . | |
| 260,230 | 6/1882 | Parker . | |
| 315,354 | 4/1885 | Ten Eyck . | |
| 638,174 | 11/1890 | Diggins . | |
| 717,119 | 12/1902 | Potter . | |
| 807,158 | 12/1905 | Dickinson . | |
| 968,017 | 8/1910 | Wilson . | |
| 986,375 | 3/1911 | Fitzner | 5/127 |
| 988,400 | 4/1911 | Stonebridge | 135/106 |
| 1,159,192 | 11/1915 | Dudley . | |
| 1,342,847 | 6/1920 | Gray . | |
| 1,464,875 | 8/1923 | Hull . | |
| 1,577,612 | 3/1926 | Dees | 52/158 |
| 2,469,805 | 5/1949 | Wilkinson . | |
| 2,776,811 | 1/1957 | Shaffer | 248/354.5 |
| 3,255,467 | 6/1966 | Kowalski . | |
| 3,318,560 | 5/1967 | Garrette | 52/165 |
| 3,345,826 | 10/1967 | Hignite | 52/726 |
| 3,541,746 | 11/1970 | Scott | 52/726 |
| 3,628,296 | 12/1971 | Henry | 52/726 |
| 3,866,619 | 2/1975 | Frisk | 248/354.1 |
| 4,100,713 | 7/1978 | Shoe | 52/726 |
| 4,229,845 | 10/1980 | de Cuadros . | |

FOREIGN PATENT DOCUMENTS

| | | | |
|---|---|---|---|
| 545846 | 3/1956 | Belgium | 248/354.1 |
| 614821 | 2/1961 | Canada | 248/354.4 |
| 972879 | 10/1959 | Fed. Rep. of Germany | 248/354.1 |
| 47872 | 7/1909 | Switzerland | 5/127 |
| 52995 | 9/1910 | Switzerland | 5/172 |
| 410595 | 5/1934 | United Kingdom | 52/155 |
| 1327574 | 8/1973 | United Kingdom | 248/354.1 |

*Primary Examiner*—Henry E. Raduazo

*Attorney, Agent, or Firm*—Saidman, Sterne, Kessler & Goldstein

[57] ABSTRACT

An apparatus for supporting non-rigid members comprising two collapsible poles, each pole comprising two tubes having substantially equal outside diameters, and joined by a connecting tube inserted inside. The connecting tube functions to secure the two tubes in coaxial alignment. A pair of earth anchors, attached to the assembled poles by guys and placed in a triangular relationship with the poles, supports the poles in a substantially vertical position. When the apparatus is in a collapsed state, the connecting tube, guys, and earth anchors can be conveniently fitted inside the two tubes to facilitate transport and storage.

9 Claims, 10 Drawing Figures

COLLAPSIBLE SUPPORT

BACKGROUND OF THE INVENTION

1. Field of the Invention

This invention relates to a hammock support and more particularly to a collapsible pole, supported by anchors and guys, comprising two tubes joined together by a connecting tube inserted therein.

2. Description of the Related Art

Portable supports for hammocks, or other non-rigid objects are known in the art. However, these supports include long poles which are so excessive in length that they are burdensome to transport and difficult to store.

Attempts have been made to try to solve the transport and storage problems inherent in the art by developing collapsible poles. However, these known collapsible poles suffer several drawbacks. In order to achieve collapsiblity, strength had to be sacrificed. These weakened poles have a tendency to bend or break at the point where the sections are attached. Efforts to prevent breaking or bending have resulted in poles whose weight is so excessive that the advantage of collapsibility is diminished because the transport of such heavy poles is impractical.

Attempts to combine strength, collapsibility, and portability have resulted in the creation of additional problems. These known supports are comprised of so many separate components that the user is not only inconvenienced by having to transport all these pieces separately, but he is required to undertake a complicated, time-consuming and often frustrating task to try to assemble the support. In addition, the user must employ a variety of tools in order to drive stakes into the ground, to dig holes and to connect the numerous pole sections, guys and anchors.

It should also be noted that since collapsible poles are not modular, not only is production of the various sections which comprise the poles expensive, but interchangeability of parts and diverse combinations using various components of the support structure are infeasible.

SUMMARY OF THE INVENTION

The present invention overcomes the aforementioned problems and deficiencies of known supports. The present invention provides a collapsible pole for supporting a hammock or non-rigid member comprising a first and second tube having substantially equal outside diameters, a connecting tube having an outside diameter smaller than the inside diameter of the first tube and insertable into the first tube, and means for securing a portion of the connecting tube inside the first tube so that the remainder of the connecting tube extends outwardly from the first tube. The second tube is adapted to be removably mounted over the portion of said connecting tube which extends outside the first tube, wherein the second tube is coaxially aligned with the first tube. The connecting tube prevents the pole from bending or breaking when a substantial weight is applied.

Preferably, an O-shaped ring provides a means for securing the connecting tube inside the first tube. The O-ring is mounted over the connecting tube with a friction fit and is insertable into the first tube to concurrently frictionally engage the inner surface of the first tube. The O-ring not only provides a easy to assemble method for joining the first and second tube, but prevents scraping noises when the pole is being used.

Alternately, the means for securing the connecting tube inside the first tube comprises support members functioning to provide a bottom support for the connecting tube. The support members may either be rigidly attached to the inner wall of the first tube or else adapted to be inserted through openings in the first tube. Again, as with the O-ring, no tools are required and assembly is simple and fast.

In another alternate embodiment, the connecting tube is fastened inside the first tube by a rigid support member which is adapted to be inserted through a pair of openings in the wall of the first tube and through a pair of holes in the connecting tube. A second rigid support member may be inserted through a pair of openings in the wall of the second tube which also pass through a pair of holes in the connecting tube for further fasten the connecting tube in position inside the first tube.

In still another alternate embodiment, the connecting tube may be secured by a vertical support member located inside the second tube. The vertical support member has one end connected to a horizontal support member which is located inside the second tube and a second end connectable to the connecting tube.

The present invention further comprises two earth anchors positioned in a substantially triangular arrangement with the first tube and means to connect the earth anchors to the second tube to support the first and second tubes in a substantially vertical position. The earth anchors can be screwed into the ground without the need for digging holes or driving stakes into the ground.

The earth anchors, the connecting means, as well as the connecting tube, conveniently fit inside the first and second tubes, thereby allowing for convenient transport and easy storage.

The present invention may further comprise a second pole and a second pair of earth anchors. The first and second poles are joined by a non-rigid member and are supported in a substantially vertical position by the earth anchors which are positioned in a substantially triangular arrangement with the first and the second poles.

BRIEF DESCRIPTION OF THE DRAWINGS

Various objects, features, and attendant advantages of the present invention will be more fully appreciated as the same becomes better understood from the following detailed description of the present invention when considered in connection with the accompanying drawings in which.

DETAILED DESCRIPTION OF THE PREFERRED EMBODIMENTS

Figure 1:
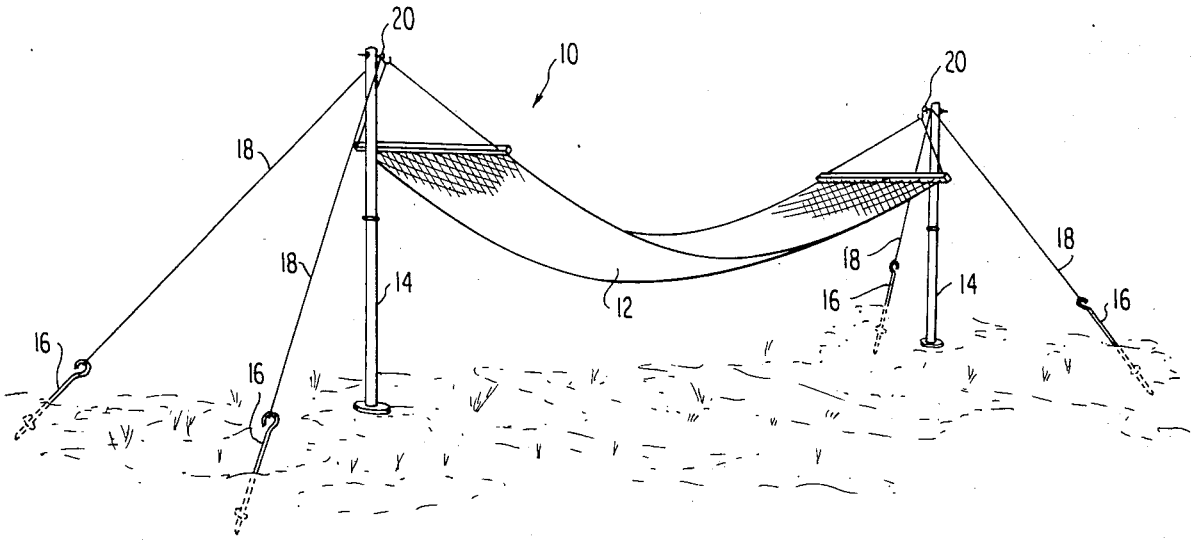
FIG. 1 is a perspective view of the hammock support of the present invention.

Referring now to FIG. 1, a hammock support 10 of the present invention is illustrated. A hammock 12 is supported on opposite ends by a pole 14. Each of the poles 14 are supported in a substantially vertical position by a pair of earth anchors 16. A guy 18 joins the earth anchors 16 to a horizontal support 20, such as an eye-bolt, located at the top portion of the pole 14. Obviously, one pole 14 can be used to support the hammock 12 if a tree or other sturdy, upright object provides an opposite end support.

Figure 2:
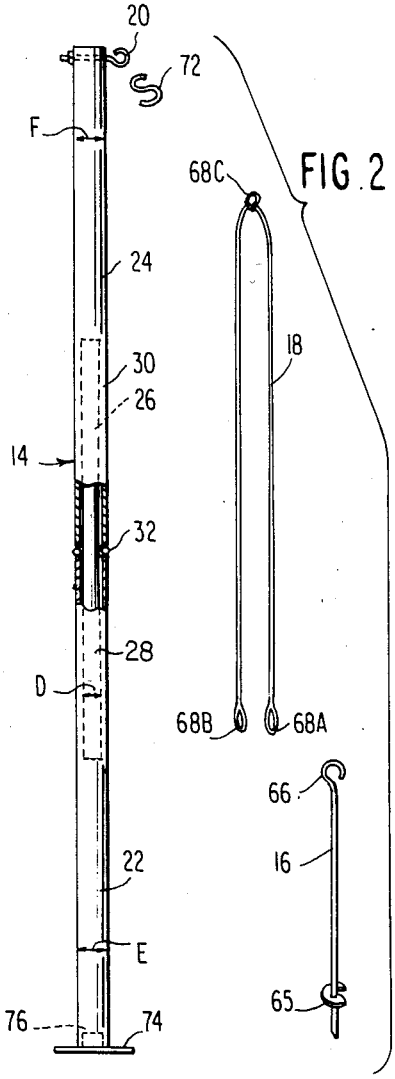
FIG. 2 is a perspective view illustrating a preferred embodiment of the components which comprise the hammock support illustrated in FIG. 1.

Referring to FIG. 2, the pole 14, which is collapsible, comprises a lower tube 22, an upper tube 24, and a connecting tube 26. The connecting tube 26, which has an outside diameter D smaller than an inside diameter E of the lower tube 22, is partially inserted into the lower tube 22 so that an inner portion 28 of the connecting tube 26 is inside the lower tube 22 and an outer portion 30 of the connecting tube 26 remains outside the lower tube 22. The upper tube 24, which has a diameter F approximately equal to the diameter E of the lower tube 22, is placed over the outer portion 30 of the connecting tube 26 to occupy a coaxial position with the first tube 22. Once assembled, the connecting tube occupies a sufficient portion of both the inside of the upper tube 24 and the inside of the lower tube 22, thereby preventing the pole 14 from bending or breaking when substantial weight is placed on the hammock 12.

In a preferred embodiment, illustrated in FIG. 2, the connecting tube 26 is held in position inside the lower tube 22 by an O-shaped ring 32. The O-ring is simply mounted over the outer surface of the connecting tube 26. Attachment of the O-ring 32 does not require the use of tools and does not entail complicated or time-consuming assembly procedures. The O-ring 32, having an outside diameter greater than the inside diameter of the lower tube 22, concurrently frictionally engages the outer surface of the connecting tube 26 and the end surface of the lower tube 22. The O-ring 32 is preferably made of rubber, but can be made of any other suitable material which functions not only to secure the connecting tube 26 in position, but advantageously provides a cushion between the lower tube 22 and the upper tube 24, thereby preventing scraping and undesirable noises when the hammock support 10 is in use.

FIGS. 4–7 illustrate alternate embodiments of the present invention, wherein elements corresponding to those shown in FIG. 2 are designated by primed (') reference numerals. In one alternate embodiment, shown in FIG. 4, the connecting tube 26 is secured in position inside a lower tube 22' by a pair of rigid supports 34. The rigid supports 34, located in a common plane substantially perpendicular to the longitudinal axis of the lower tube 22', are permanently attached to the inside wall of the lower tube 22' and provide a bottom support for the connecting tube 26.

Figure 7:
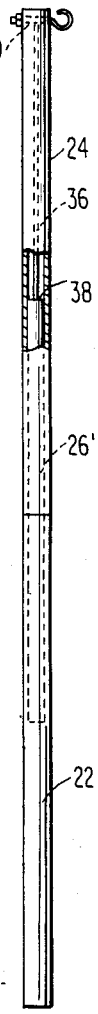
FIG. 7 is yet another alternate embodiment of the collapsible pole in its assembled position.

In another alternate embodiment, depicted in FIG. 7, a strap support 36 is connected at one end to the horizontal support 20. The strap support 36 extends downwardly, parallel to the longitudinal axis of the upper tube 26, to engage a top section 38 of a connecting tube 26'. The strap support 36 is of sufficient length to enable approximately one-half of the connecting tube 26' to remain inside the lower tube 22, thereby ensuring that the lower tube 22 and the upper tube 24 are held in a coaxially aligned position by the connecting tube 26'.

Figure 5:
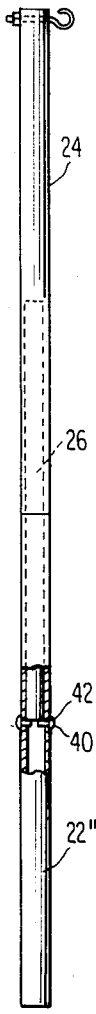
FIG. 5 is yet another alternate embodiment of the collapsible pole in its assembled position.

In another alternate embodiment, shown in FIG. 5, the connecting tube 26 is supported on the bottom by a pair of screws 40 which are inserted through a pair of openings 42 in the wall of a lower tube 22'. The openings 42 are located in a common plane substantially perpendicular to the longitudinal axis of the lower tube 22''. Each of the screws 42 extends part way towards the opposite wall of the lower tube 22'', thereby preventing the connecting tube 26 from sliding further down inside the lower tube 22''. Obviously other rigid objects can be inserted through the openings 42 as long as they provide a strong bottom support for the connecting tube 26.

Figure 6:
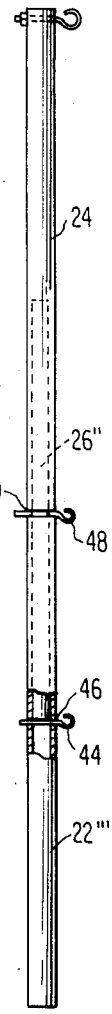
FIG. 6 is still another alternate embodiment of the collapsible pole in its assembled position.

Alternately, as FIG. 6 illustrates, a bottom pin 44 is inserted through a pair of openings 46 located in the wall of the lower tube 22'''. The bottom pin 44 provides a bottom support for a connecting tube 26'' when it is inserted inside the lower tube 22'''. Additionally or alternatively, a middle pin 48 may be inserted to provide additional support for the connecting tube 26''. The middle pin 48 is inserted through a pair of holes 50 in the connecting tube 26''; the lower end of tube 26'' and the upper end of the tube 22''' abut up against pin 48. The middle pin 48 functions to provide additional lateral support, primarily for connecting tube 26''.

Figure 3:
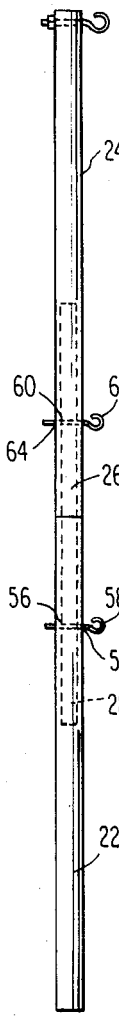
FIG. 3 is a perspective view of an alternate embodiment of the collapsible pole in its assembled position.
Figure 4:
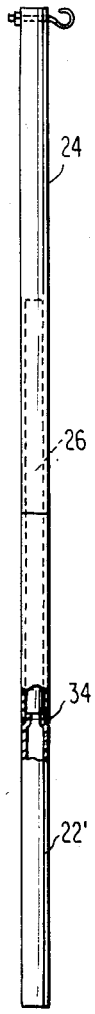
FIG. 4 is another alternate embodiment of the collapsible pole in its assembled position.

FIG. 3 illustrates yet another alternate embodiment of the pole 14 of the present invention. A pair of openings 54 are located in the wall of a lower tube 22''''. Located in an inner portion 28' of a connecting tube 26''' are a pair of holes 56 which are in alignment with the pair of openings 54 when the connecting tube 26''' is inserted inside the lower tube 22''''. A lower pin 58 is inserted through the openings 54 and holes 56 in order to fasten the connecting tube 26'''. The connecting tube 26''' may further comprise a upper pair of holes 60 which are in alignment with an upper pair of openings 64 located in the wall of the second tube 24'. An upper pin 62 can be inserted through the holes 60 and through the upper pair of openings 62 to further fasten the connecting tube 26'''.

Referring again to FIGS. 1 and 2, the earth anchors 16 and the guys 18 support the pole 14 in an upright position. Each of the earth anchors 16 has an earth anchor screw 65 which enables the earth anchors 16 to be easily screwed into sand or soil by using a simple wood turning tool. Obviously, the earth anchor 16 may instead have a helix, so long as the difficult and time-consuming task of digging holes or driving stakes into the ground are eliminated. Located on the opposite end of the earth anchor 16 is an open eye 66. The open eye 66 preferably measures one-fourth inch, thereby allowing a loop 68A or 68B of the guy 18 to be inserted therein to join the earth anchors 16 to the pole 14.

Figure 9A:
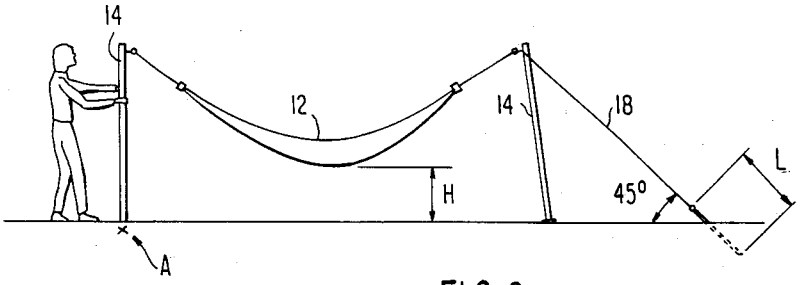
FIG. 9A is a side view of the hammock support in a partially assembled state.
Figure 9B:
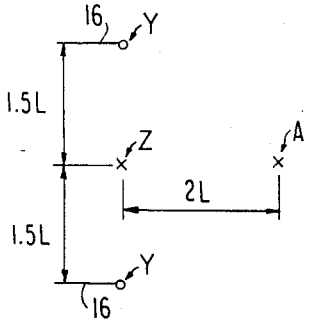
FIG. 9B illustrates preferred positions of the earth anchors in relation to the assembled pole.

The earth anchors 16 are inserted into the ground, angled towards the pole 14. Preferably, each of the earth anchors 16 forms a 45° angle with the ground. As FIGS. 9A and 9B illustrate, the length L of the earth anchors 16 conveniently provide a measuring unit facilitating the assembly of the hammock support 10. Subsequent to the insertion of the earth anchors 16 into the ground and the connection of the guy 18 and the hammock 12 to one of the poles 14, the second pole 14 is joined to the unattached end of the hammock 12. The second pole 14 is then moved away from the upright pole 14 to a reference point A, where the hammock 12 is a desired distance H, preferably $1\frac{1}{2}$ feet, above the ground. The earth anchors 16 are then placed in a triangular relationship with reference point A. Preferably, each of the earth anchors 16 is inserted at point Y at an angle of 45° with the ground. Point Y is located at a distance 2L from the reference point A and a distance 1.5L from the reference point Z. As a result, the distance of each of the earth anchors 16 from the pole 14 is defined by:

$$\sqrt{(1.5L)^2+(2L)^2}.$$

Once inserted into the ground, loops 68A and 68B of the guy 18 are respectively connected to the open eyes 66 of earth anchors 16. The midpoint portion 68C of the guy 18 loops around the upper part of the support pole 24 above the horizontal support member 20 and rests on the support member 20. This arrangement provides a means for stabilizing and maintaining the vertical alignment of the support pole 14 and for adjusting the height of the hammock 12. Preferably and advantageously, loop portions 68A and 68B and midpoint portion 68C of guy 18 are protected from abrasion by, for example, tape or plastic sheathing. The S-hook 72 is slipped through an eye-bolt 20 which is connected to a portion of the horizontal support 20 which protrudes outside the wall of the upper tube 24. Once both loops 68a and 68B of the guy 18 are connected to the earth anchors 16 and poles 14, respectively, the poles 14 are then maintained in a substantially vertical position by the counter forces of the earth anchors 16 at one end and the hammock 12, opposing pole 14, and opposing earth anchor 16 at the other end. In addition, an end cap 74, located at the bottom of pole 14, seals the lower tube opening 76, thereby advantageously preventing sand or dirt from entering the lower tube 22, which would otherwise cause the poles 14 to sink into the ground.

Figure 8:
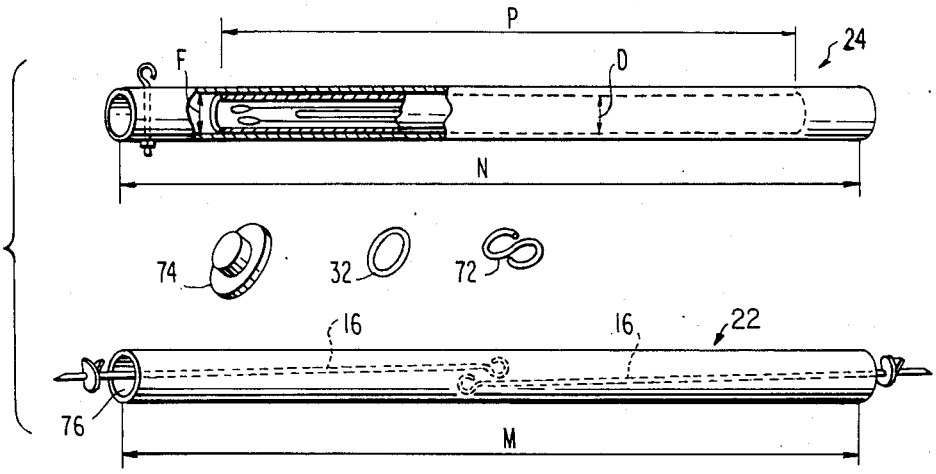
FIG. 8 is a perspective view of the pole in its collapsed state showing certain components of the hammock support stored inside.

The portability and storage advantages of the hammock support 10 of the present invention can be seen in FIG. 8. The inside diameters E and F of the lower tube 22 and the upper tube 24 are both greater than the outside diameter D of the connecting tube 26. Preferably, the diameters E and F measure 2 inches and the diameter D measures $1\frac{1}{2}$ inches. Length M of the lower tube 22 and length N of the upper tube 24 are greater than length P of the connecting tube 26. These diameter and length relationships enable the connecting tube 22 and the guys 18 to be conveniently stored inside the upper tube 24 when the pole 14 is in a collapsed state. Also, the length M of the lower tube 22 is sufficiently long and the lower tube opening 76 is sufficiently large to enable almost the entire length of earth anchors 16 to fit inside; in the presently contemplated commercial embodiment, each earth anchor 16 has a length approximately equal to M. As shown in FIG. 8, other lengths are also possible. This arrangement facilitates transport and storage of the device. The end cap 74, S-hook 72, and O-ring 32 can be conveniently carried and stored in any small case.

Other diverse combinations, using the hammock support 10, can be easily constructed due to the modularity and easy-to-assemble features of the present invention. For example, additional pole sections 22 and/or 24 may be combined with additional connecting tubes 26 to increase the height of the support pole 14, thereby permitting its use as, e.g., a volleyball net support.

Obviously, numerous modifications and variations of the present invention are possible in light of the above teachings. It is therefore to be understood that within the scope of the appended claims, the invention may be practiced otherwise than as specifically described herein.

What is claimed is:

1. A free-standing collapsible supporting member kit comprising:

first and second hollow tubes each having at least one open end and substantially equal outside diameters;

a connecting tube stored in said first tube when in a disassembled condition, said connecting tube having an end-to-end length substantially less than the combined end-to-end length of said first and second tubes in an assembled condition;

a plurality of earth anchors stored in one of said tubes when in said disassembled condition and joining means stored in one of said tubes when in said disassembled condition; and locating means adapted to cooperate with said connecting tube and said first tube in the assembled condition;

wherein, in the assembled condition said locating means locates one end portion of the connecting tube within said first tube such that a second, opposite end portion of said connecting tube protrudes outwardly from said first tube, said second tube is placed over said second end portion of said connecting tube in substantial coaxial alignment with and substantially abutting said first tube, to thereby maintain said first and second tubes in said assembled condition, and said joining means connects said earth anchors to one of said first and second tubes to thereby secure said first and second tubes in a substantially vertical position when said first and second tubes are held in coaxial alignment by said connecting tube in said assembled condition.

2. A kit as recited in claim 1, wherein said locating means comprises an O-shaped ring adapted to be mounted over the connecting tube with a friction fit, said O-ring having an outside diameter greater than the inside diameter of said first and second tubes.

3. A kit as recited in claim 1, wherein said locating means comprises:

at least one opening in the wall of said first tube; and a rigid support member adapted to be inserted through said openings to thereby provide a bottom support for said connecting tube.

4. A kit as recited in claim 1, wherein said means locating means comprises:

at least one pair of oppositely disposed openings in the wall of said first tube;

at least one pair of holes in the wall of said connecting tube, said holes being in alignment with said openings in said first tube when said connecting tube is inserted therein; and a rigid support member adapted to be inserted through said openings and holes to thereby fasten said connecting tube in position inside said first tube.

5. A kit as recited in claim 4, further comprising:

at least one pair of oppositely disposed openings in the wall of said second tube;

at least one pair of holes in the wall of said connecting tube, said holes being in alignment with said second tube when said connecting tube is inserted therein; and a rigid support member adapted to be inserted through said openings and holes to thereby fasten said connecting tube in position inside said first tube.

6. A kit as recited in claim 1, wherein said locating means comprises first and second rigid support members located in a common plane substantially perpendicular to the longitudinal axis of said first tube and attached to the inner wall of said first tube, said first and second support members each extending part way towards the opposite wall to provide a bottom support for said connecting tube.

7. A kit as recited in claim 1, wherein said means to secure said connecting tube comprises:

at least one pair of openings in the wall of said first tube, said openings being located in a common plane substantially perpendicular to the longitudinal axis of said first tube; and at least one pair of rigid support members, each said support member being adapted to be inserted through one of said openings and extending part way towards the opposite wall of said first tube to thereby provide a bottom support for said connecting tube.

8. A kit as rectied in claim 1 further comprising:

first and second support members;

said first support member being located inside said second tube perpendicular to the longitudinal axis of said second tube and having a length at least equal to the inside diameter of said second tube; and said second support member being located parallel to the longitudinal axis of said second tube and having a first end connected to said first support member and a second end connectable to said connecting tube to thereby provide said means to secure said connecting tube inside said first tube.

9. A kit as recited in claim 1, wherein said locating means comprises an O-shaped ring adapted to be mounted over the connecting tube with a friction fit, said O-shaped ring having a outside diameter greater than the inside diameter of said first and second tubes.

* * * * *